United States Patent [19]

Williams et al.

[11] 4,098,234

[45] Jul. 4, 1978

[54] ENGINE CONTROL SYSTEM

[75] Inventors: Malcolm Williams, Solihull; Adrian Walter Melady, Stourport, both of England

[73] Assignee: The Lucas Electrical Company Limited, Birmingham, England

[21] Appl. No.: 493,277

[22] Filed: Jul. 31, 1974

[30] Foreign Application Priority Data

Aug. 11, 1973 [GB] United Kingdom ..... 38153/73

[51] Int. Cl.[2] ..... F02B 3/00; F02P 5/04

[52] U.S. Cl. ..... 123/32 EA; 123/32 EB; 123/32 EC; 123/117 D

[58] Field of Search ..... 123/32 EA, 117 D, 32 EC, 123/32 EB

[56] References Cited

U.S. PATENT DOCUMENTS

| | | | |
|---|---|---|---|
| 3,780,711 | 12/1973 | Lindberg | 123/32 EA |
| 3,785,353 | 1/1974 | Borisov et al. | 123/32 EA |
| 3,796,199 | 3/1974 | Knapp | 123/32 AE |
| 3,817,231 | 6/1974 | O'Neill | 123/32 EA |
| 3,831,563 | 8/1974 | Brittain et al. | 123/32 EA |
| 3,832,981 | 9/1974 | Wakamatsu et al. | 123/32 EA |

*Primary Examiner*—Charles J. Myhre
*Assistant Examiner*—Parshobam S. Lall
*Attorney, Agent, or Firm*—Olson, Trexler, Wolters, Bushnell & Fosse, Ltd.

[57] ABSTRACT

In an engine control system, particularly for fuel injection, the frequency of a variable frequency clock is compared with an output signal from a memory device and the difference used to control an engine function. The frequency of the clock is determined by the collector current of the transistor having two variable resistors controlling its emitter and base currents respectively.

4 Claims, 1 Drawing Figure

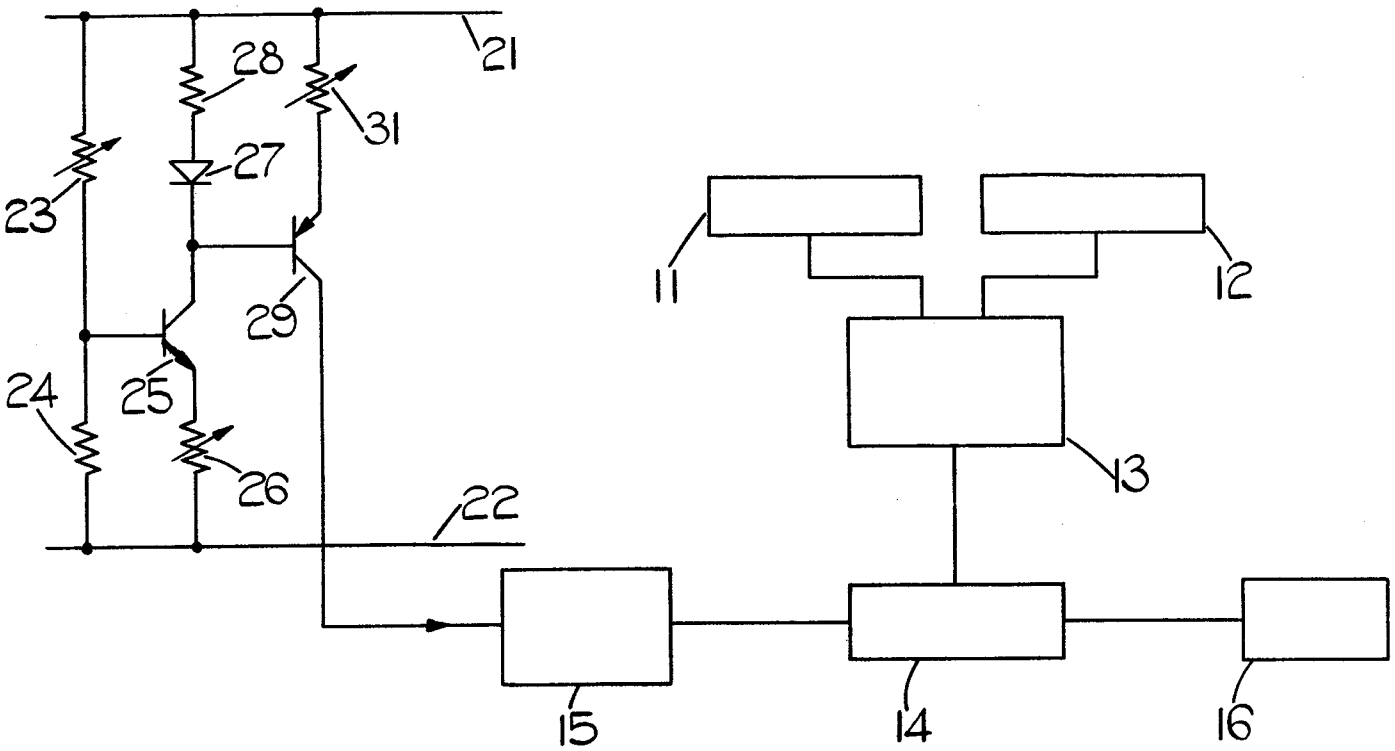
11
12
13
14
15
16
21
22
23
24
25
26
27
28
29
31

ENGINE CONTROL SYSTEM

This invention relates to engine control systems and is particularly, but not exclusively, intended for use in fuel injection systems for engines.

A control system according to the invention comprises a memory unit producing a digital output dependent on the values of one or more engine parameters, a comparator to which said output is fed, a variable frequency clock coupled to said comparator, control means responsive to the time taken for the clock to count to the digital signal in the comparator for controlling an engine function, and a trim control for varying the clock frequency in accordance with at least two further engine parameters to modify said time for a given output from the memory unit, said trim control comprising a transistor the collector current of which determines the frequency of the clock.

Preferably, the system includes two independently acting variable resistors responsive to said two further engine parameters respectively and controlling respectively the emitter and base currents of said transistor.

The accompanying drawing is a circuit diagram, partly in block form, illustrating one example of the invention as applied to a fuel injection system for an internal combustion engine driving a road vehicle.

Referring to the drawing, there are provided a pair of transducers 11, 12 producing output signals representing the values of two engine parameters, the parameters being any two chosen from the group consisting of throttle angle, manifold depression and engine speed. The outputs from the transducers 11, 12 are fed to a memory unit 13 which provides a digital output to a comparator 14, this digital output being dependent upon the outputs from the transducers 11 and 12, and representing the required quantity of fuel for the prevailing engine conditions.

The comparator 14 is also coupled to a clock 15 and provides an output signal to an output stage 16. Injection of fuel is commenced at a predetermined instant of time, and at this time there will be a signal in the comparator 14 determined by the outputs from the transducers 11 and 12. The clock 15 then feeds pulses to the comparator 14, and after a predetermined period of time, the number of pulses fed the clock 15 to the comparator 14 will be equal to the count in the comparator 14 set by the memory 13. At this point, injection of fuel can be terminated. The count for which fuel is injected will of course depend upon the signal fed to the comparator 14 by the memory unit 13, and on the frequency of the clock 15.

This part of the arrangement is known, and is not for this reason described in any great detail. It should be noted that the simplified explanation given above assumes that for each injection of fuel, the comparator 14 is scanned by the clock 15 once. In the practical arrangement, the clock 15 may well scan the comparator 14 several times for each injection of fuel, and the signal fed to the comparator 14 by the memory 13 during each injection can be varied. However, these refinements are not important to an understanding of the present invention.

The circuit further includes positive and negative supply lines 21, 22, and connected in series between the lines 21, 22 are a variable resistor 23 and a resistor 24. The junction of the resistors 23 and 24 is connected to the base of a *n-p-n* transistor 25 having its emitter connected through a variable resistor 26 to the line 22 and its collector connected to the line 21 through a diode 27 and a resistor 28 in series. The collector of the transistor 25 is further connected to the base of a *p-r-p* transistor 29, the emitter of which is connected through a variable resistor 31 to the line 21 and the collector of which is connected to the clock 15.

The collector current of the transistor 29 determines the frequency of the clock 15, and the resistors 23, 26 and 31 are variable in accordance with the value of three further engine parameters so as to vary the frequency of the clock and so provide a trim control for the quantity of fuel injection. It will be seen that for given values of the resistors 23, 26 and 31 the collector current of the transistor 29 will be constant. However, variation in value of either the resistors 23 or 26 modifies the base voltage of the transistor 29 by controlling the collector current of the transistor 25, and variation in value of the resistor 31 modifies the emitter current of the transistor 29. Thus, each of the resistors 23, 26, 31 independently controls the collector current of the transistor 29, and alteration of any of the parameters sensed by the resistors 23, 26, 31 will vary the frequency of the clock 15 and so modify the quantity of fuel injection for given values of the parameters sensed by the transducers 11 and 12.

There are a number of factors which can be taken into account using the resistors 23, 26 and 31. By way of example, a trim can be effected in accordance with air temperature, barometric pressure or engine temperature. Also, one of the resistors 23, 26, 31 can be used to provide increased fuel when the engine is being cranked.

We claim:

1. An engine control system comprising a memory unit producing a digital output dependent on the values of one or more engine parameters, a comparator to which said output is fed, a variable frequency clock coupled to said comparator, control means responsive to the time taken for the clock to count to the digital signal in the comparator for controlling an engine function, and a trim control for varying the clock frequency in accordance with at least two further engine parameters to modify said time for a given output from the memory unit, said trim control comprising a transistor the collector current of which determines the frequency of the clock.

2. A system as claimed in claim 1 including two independently acting variable resistors responsive to said two further engine parameters respectively and controlling respectively the emitter and base currents of said transistor.

3. A system as claimed in claim 2 in which the resistor which controls the base current of the transistor is itself positioned in the emitter circuit of a second transistor, the collector of which feeds the base of the first-mentioned transistor.

4. A system as claimed in claim 3 including a third variable resistor in the base circuit of the second transistor.

* * * * *